US005209343A

United States Patent [19]

Romano et al.

[11] Patent Number: 5,209,343

[45] Date of Patent: May 11, 1993

[54] ELECTRICAL TILT SWITCH

[75] Inventors: Robert P. Romano, Glen Ridge; James L. Weaver, Passaic, both of N.J.

[73] Assignee: Comus International, Nutley, N.J.

[21] Appl. No.: 822,641

[22] Filed: Jan. 21, 1992

[51] Int. Cl.[5] ..... H01H 35/02; H01H 35/14

[52] U.S. Cl. ..... 200/61.52; 200/61.45 R; 200/61.83

[58] Field of Search ..... 200/61.45 R–61.53, 200/DIG. 29, 277–277.2, 61.83

[56] References Cited

U.S. PATENT DOCUMENTS

| | | | |
|---|---|---|---|
| 2,107,570 | 2/1938 | Hobbs | 200/61.83 |
| 2,228,456 | 1/1941 | Hobbs | 200/61.83 |
| 2,997,557 | 8/1961 | Gillmor et al. | 200/61.45 R |
| 3,706,867 | 12/1972 | Rand et al. | 200/61.52 |
| 3,748,415 | 7/1973 | Suzuki | 200/61.45 M |
| 3,831,163 | 8/1974 | Byers | 200/61.45 R X |
| 4,023,346 | 5/1977 | Kayser | 200/DIG. 29 X |
| 4,082,927 | 4/1978 | Beckwith | 200/52 R |
| 4,097,698 | 6/1978 | Jackman | 200/61.45 R |
| 4,450,326 | 5/1984 | Ledger | 200/61.45 M |
| 4,503,299 | 3/1985 | Henrard et al. | 200/61.52 |
| 4,520,257 | 5/1985 | Schwob et al. | 200/61.52 |
| 4,628,160 | 12/1986 | Canevari | 200/61.45 R |
| 4,697,174 | 9/1987 | Viator, Sr. | 200/61.52 X |
| 4,956,629 | 9/1990 | Chen | 200/61.83 X |
| 5,123,499 | 6/1992 | Breed et al. | 200/61.45 M X |
| 5,136,126 | 8/1992 | Blair | 200/61.52 |

*Primary Examiner*—J. R. Scott
*Attorney, Agent, or Firm*—Arthur L. Plevy

[57] ABSTRACT

A tilt switch having at least one conductive weight held within an inert atmosphere within a housing. The weight being free moving within the housing, moving from one end of the housing to the other as the angle of inclination of the housing is changed. At one end of the housing are positioned the contact points of at least two terminals. As the weight abuts against the terminals, electricity is conducted through the weight from one terminal to the other; thus completing a circuit. The terminals may be shaped, or the number of conductive weights increased, to increase the area of contact between the weights and the terminals. The increased surface area results in a more reliable tilt switch that has increased performance characteristics and a higher power capacity.

19 Claims, 11 Drawing Sheets

ELECTRICAL TILT SWITCH

FIELD OF THE INVENTION

The present invention relates to tilt switches and more particularly to such switches that utilize at least one free moving weight enclosed within a housing, to activate or deactivate the switch as a function of the angle of inclination of the switch.

BACKGROUND OF THE INVENTION

Electrical tilt switches and like devices can operate to switch electrical circuits ON and OFF as a function of the angle of inclination of the switch. Such switches normally include a free moving electrically conductive element that contacts at least two terminals when the conductive element moves to an operating position by gravity. A well known form of the electrical tilt switch is the mercury switch. In a typical mercury switch, a glob of mercury moves freely within a housing. As the housing is inclined, gravity pulls the glob of mercury to one end of the housing where it completes an electrical circuit.

Mercury tilt switches are fairly easy to manufacture, however, due to environmental concerns, it is becoming increasingly difficult to manufacture any product that includes mercury. Mercury is a highly toxic substance. As such, there exists a large number of federal, state and local guidelines controlling the use, storage and disposal of mercury. The increase in governmental regulation has increased the cost of manufacturing mercury switches to a point where alternative non-mercury tilt switches have become more competitive.

When manufacturing a tilt switch without mercury, a substitute free moving conductive element must be used. A common substitute is a single metal ball. Tilt switches utilizing metal balls in place of globs of mercury are exemplified in U.S. Pat. Nos. 4,628,160 to Canevari, 4,467,154 to Hill, 4,450,326 to Ledger and 3,706,867 to Raud et al. The use of a metal ball to complete an electric circuit is a simple and inexpensive way to create a tilt switch. However, metal balls do have certain inherent disadvantages. A metal ball contacts a flat surface only along its tangent. Consequently, only a small area of the metal ball is in actual electrically conductive contact within the switch. Adversely, with mercury switches, the mercury glob would envelope a terminal as it contacted it, resulting in a large surface area through which electricity could be conducted. The comparatively small surface area of a metal ball, through which electricity can be conducted, has made metal ball tilt switches less reliable than mercury switches.

Another disadvantage of metal ball tilt switches is that when a metal ball does contact a terminal, the resulting electrical coupling across the contact area is poor. In a mercury switch, the mercury glob would flow into any pit or void it encountered on a terminal, creating a good electrical coupling. However, with metal ball tilt switches, the metal ball is unable to conduct electricity across any pits or voids that exist on either the surface of the terminal or the metal ball itself. Since electricity passes through the metal ball from the terminal it is contacting, arcing can occur across any void in the contact surface. The arcing may cause pitting or corrosion on both the metal ball and the terminal, reducing the conductivity of both surfaces.

It is therefore a primary objective of the present invention to create a more reliable tilt switch utilizing a free moving weight such as a metal ball as the contact element, wherein the contact area between the metal ball and a terminal is increased.

It is yet another objective of the present invention to create a more reliable tilt switch utilizing free moving weight such as a metal ball as the contact element, wherein the pitting and corrosion caused by the arcing of electricity between the metal ball and a terminal is reduced.

SUMMARY OF THE INVENTION

The present invention provides a new and improved tilt switch that is highly reliable, inexpensive to manufacture and does not involve hazardous materials such as mercury. More specifically, preferred embodiments of the present invention tilt switch includes at least one free moving weight such as a metal ball that travels freely within a housing. As the angle of inclination of the housing is changed, the weight travels from one side of the housing to the other. At one end of the housing are placed a source and drain terminal within an electric circuit. As the weight travels to an operating position within the housing, the weight contacts both terminals. Since the weight is conductive, electricity flows through the weight from one terminal to the other; thus completing the electric circuit. To prevent pitting or other corrosion from forming on the weight that might adversely effect both the ability of the weight to move and the surface conductivity of the weight, the housing encapsulating the weight is filled with an inert atmosphere that will not react with the material of the weight.

One preferred embodiment of the free moving weight is a rounded weight such as a single metal ball. Ball weights contact a flat surface along its tangent, leaving a very small area through which the flow of electricity can pass. By using a plurality of weights, the area of contact between the ballweights and the terminals increases proportionally. Additionally, a plurality of balls create a weight behind the most forward lying balls. The weight of the other ball weights presses the forward lying balls firmly against the terminals. The increased surface contact area and contact pressure increases the conductivity between the ballweights and the terminals, resulting in a tilt switch with an increased reliability and switching capacity.

In alternate embodiments of the present invention tilt switch, a barrier may be placed in the pathway of the balls. The barrier may delay the weights from opening or closing the tilt switch until the housing supporting the weights has been inclined beyond a critical angle.

The present invention may also include shaped terminals that match the contours of the weights. Such shaped electric leads increasing the area of contact, and thus the reliability, of the tilt switch.

BRIEF DESCRIPTION OF THE FIGURES

For a better understanding of the present invention, reference is made to the following description of an exemplary embodiment thereof, considered in conjunction with the accompanying drawings, in which.

DETAILED DESCRIPTION OF THE DRAWINGS

Figure 2:
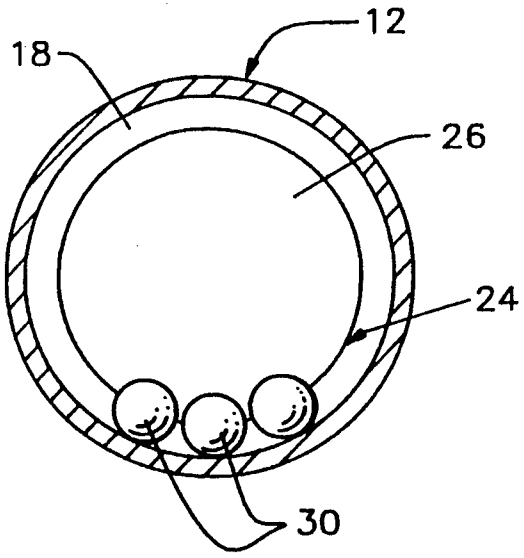
FIG. 2 is a cross-sectional view of the embodiment of the present invention shown in FIG. 1 cut along section line 2—2.
Figure 1:
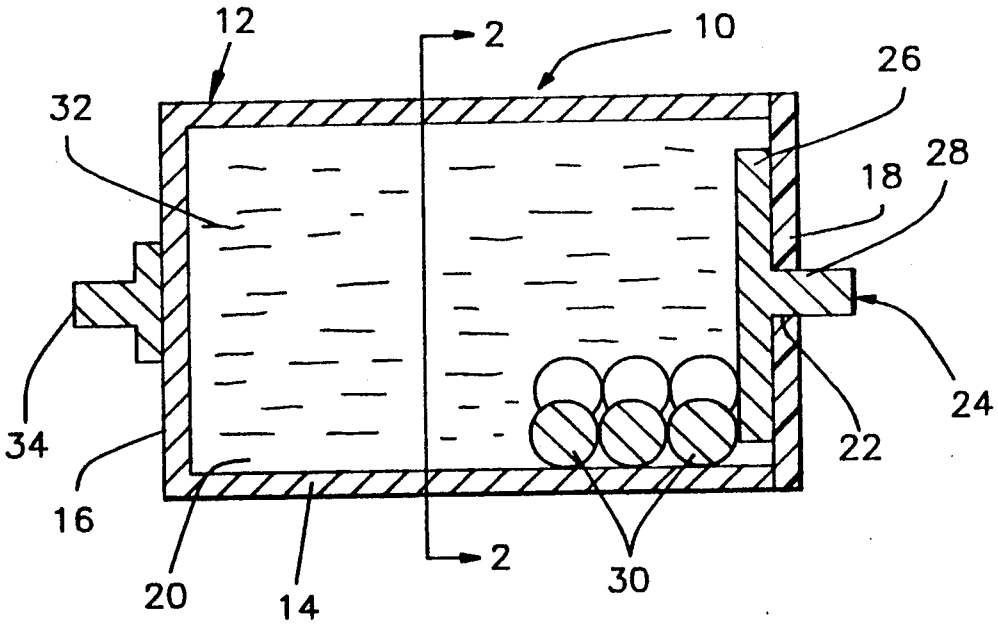
FIG. 1 is a cross-sectional view of an electric tilt switch instructed in accordance with one exemplary embodiment of the present invention.

Referring to FIGS. 1-2, a tilt switch 10 is shown. The tilt switch 10 is comprised of an electrically conductive housing 12 that is cup-shaped having a substantially tubular jacket 14 and one closed end 16. The housing 12 may be unistructural, as is shown, or the tubular jacket 14 and the closed end 16 may be separate components joined in an air tight manner. The open end of the housing 14 is covered by a dielectric end cap member 18. The end cap member 18 is joined to the housing 14 forming a gas impervious seal; thus creating a hollow 20 within the housing 14 that is isolated from the surrounding environment. An aperture 22 is formed through the end cap member 18, through which an electrical connector 24 is placed. The electrical connector 24 has an enlarged circular head 26 and a cylindrical stem 26, giving the electrical connector 24 a substantially T-shaped profile. The stem 26 of the electrical connector 24 passes through the end cap member aperture 16. The enlarged circular head 26, positioned within the hollow 20, abuts against the end cap member 18 and seals the aperture 22.

A plurality of conductive balls 30 are positioned within the housing 12. The conductive balls 30 may be fabricated from a high density material such as lead, steel or the like, and may include a plating such as copper, nickel or gold to create or increase surface conductivity. The size of the conductive balls 30 and enlarged head 26 of the electrical connector 24 are so proportioned so that when a ball 30 abuts against the electrical connector 26, the ball 30 contacts both the electrical connector 26 and the tubular jacket 14 of the housing 12 along perpendicular tangents.

The hollow 20 isolated within the housing 12 is filled with an inert gas 32 such as nitrogen, neon or the like. The inert gas 32 provides a non-corrosive environment for the conductive balls 30, preventing oxidation, pitting and other corrosion common to electrical contacts. It should be understood that although the presence of an inert gas 32 is preferred, a non-corrosive environment can be formed within the housing 14 by evacuating the housing 14 of all gases or filling the housing with a low viscosity, non-conductive liquid such as silicon oil.

A terminal 34 is connected to the housing 14. The terminal 34 coupling the housing 14 to a source of electrical potential (now shown). The cylindrical stem 28 of the electrical connector 24 extends through the end cap member 18 and is coupled to an opposing source of electrical potential (not shown). The electrical connector 24 is electrically insulated from the housing 14 by the presence of the dielectric nature of the end cap member 18, thus an open circuit exists between the housing 14 and the electrical connector 24.

In operation, the plurality of conductive balls 30 are free moving within the housing 14. When the housing 14 is inclined, gravity pulls the conductive balls 30 toward the closed end 16 of the housing 14, and the conductive balls 30 roll against the closed end 16 of the housing 14 such that no electrical connection exists between the housing 14 and the electrical connector 24. When the housing 14 is inclined such that gravity pulls the conductive balls 30 in the direction of the electrical connector 24, the conductive balls 30 roll against the enlarged head 26 of the electrical connector 24. Since there are a plurality of conductive balls 30 in the housing 14, each having a relatively small diameter in relation to the housing 14, the balls 30 do not remain in a linear orientation as the housing 14 is inclined. As such, when the conductive balls 30 are biased toward the electrical connector 24, the balls 30 pile up so that more than one ball 30 will directly contact the flat head 26 of the electrical connector 24. Obviously, the greater the tilting grade of the housing 14, the more conductive balls 30 are likely to directly contact the electrical connector 24. Each conductive ball 30 that directly abuts against the electrical connector 24 simultaneously abuts against the tubular jacket 14 of the housing 12 along a perpendicular tangent. The presence of the conductive balls 30 between the housing 12 and the electrical connector 24 completes the electrical circuit, allowing electricity to flow between the housing 12 and the electrical connector 24 through the conductive balls 30.

Since a plurality of conductive balls 30 are simultaneously contacting the housing 12 and the electrical connector 24, the overall area in direct electrical contact between the housing 12 and the electrical connector 24 is obviously greater than if only one ball were used. Additionally, each conductive ball 30 is in direct electrical contact to all the other conductive balls 30 it abuts against. As such, the overall area of contact increases proportionately to the number of balls 30 used in the switch 10. Not all the conductive balls 30 abut against both the electrical connector 24 and the housing 12 simultaneously. Many conductive balls 30 stack against each other in the housing 12 behind the most forward lying balls that abut directly against the electrical connector 24. The weight of the conductive balls 30 stacking against each other press the forward lying balls firmly against the electrical connector 24 ensuring a good electrical contact.

Other embodiments of the present invention tilt switch are illustrated in FIGS. 3–17. Various elements which correspond in form and function to the elements as previously described above, are designated by a corresponding reference numeral increased by a multiple of one hundred and operate in the same manner as has been described in FIGS. 1–2 unless otherwise stated.

Figure 4:
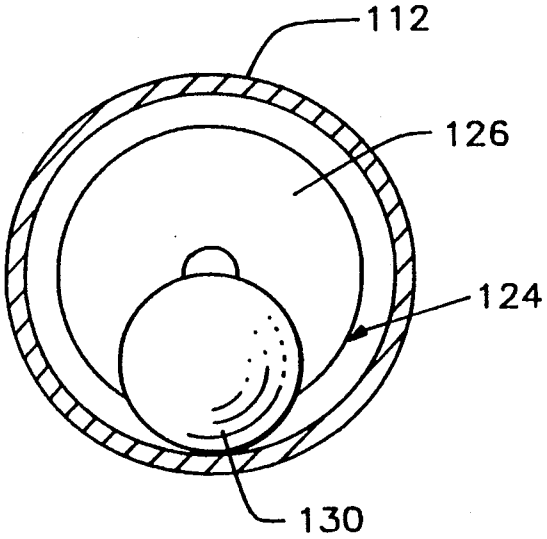
FIG. 4 is a cross-sectional view of the embodiment of the present invention shown in FIG. 3 cut along section line 4—4.
Figure 3:
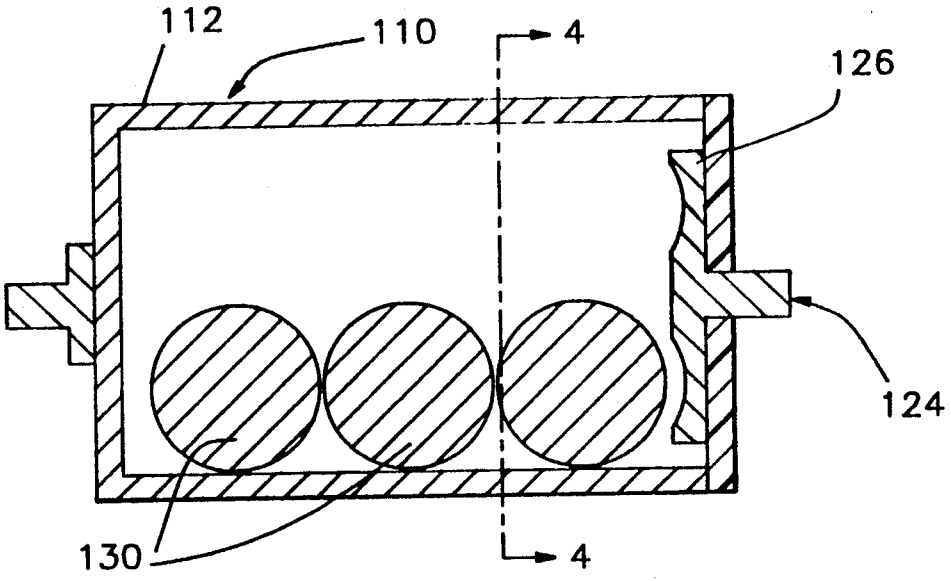
FIG. 3 is a cross-sectional view of an electric tilt switch constructed in accordance with a second exemplary embodiment of the present invention.

Referring to FIGS. 3–4, a second preferred embodiment of the present invention tilt switch 110 is shown. The switch 110 is substantially identical in form and function to the switch 10, previously described in relation to FIGS. 1–2, except the conductive balls 130 are now larger and fewer in number and the electrical connector 124 is shaped. With large conductive balls 130 only one ball can abut against the enlarged head 126 of the electrical connector 124. The use of larger conductive balls 130 has advantages in that the weight of all the balls 130 is concentrated, pressing the forward lying ball against the electrical connector 124. As such, a firm electrical contact is maintained. The use of one or a few large conductive balls 130 as opposed to a multitude of small conductive balls ensures that the conductive balls 130 remain in a linear orientation as they roll back and forth in the housing 112. Consequently, very sensitive switches can be fabricated by proportioning the length of the housing 112 to be only slightly greater than the combined length of the conductive balls 130.

Also shown in this embodiment is a groove 127 formed into the enlarged head 126 of the electrical connector 124 and facing the conductive balls 130. The groove 127 is formed with the same radius of curvature as is the conductive balls 130 and is positioned on the electrical connectors 124 so as to correspond in position with the conductive balls 130. As the conductive ball 130 rolls against the electrical connector 124, the conductive ball 130 fits into the groove 127, producing a large area of conductive contact.

It should be understood that although three conductive balls 130 are shown in this embodiment, one ball and/or a plurality of balls 130 could be used.

Figure 5:
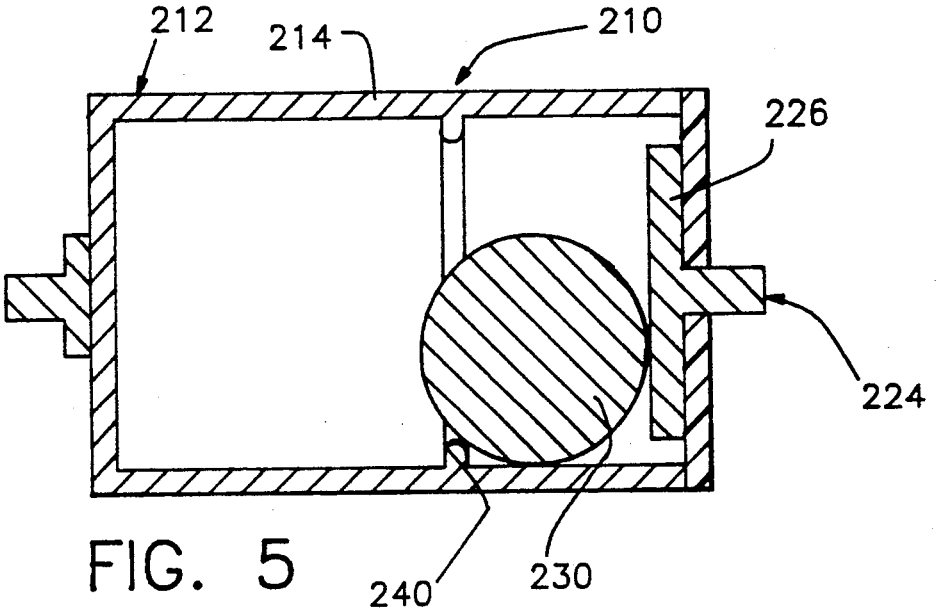
FIG. 5 is a cross-sectional view of an electric tilt switch constructed in accordance with a third exemplary embodiment of the present invention.

In FIG. 5 a tilt switch 210 is shown having only one conductive ball 230. The switch 210 has the added feature of a small protrusion 240 being annularly formed about the inside surface of the tubular jacket 214 of the housing 212. The protrusion 240 is so positioned so that when the conductive ball 230 is in between the protrusion 240 and the electrical conductor 224, the conductive ball 230 will be in abutment with the enlarged head 226 of the electrical conductor 224, electrically coupling the same.

The protrusion 240 acts as a mechanical delay as the switch 210 is inclined. The delay gives the switch 210 an instant on, instant off characteristic. For example, if the conductive ball 230 were on the electrical connector 224 side of the protrusion (as is shown), the switch 210 is "on" because the conductive ball 230 is conducting electricity between the housing 212 and the electrical connector 224. As the switch 210 is inclined, elevating the electrical connector 224, gravity wants to make the conductive ball 230 roll away from the electrical connector 224; thus putting the switch 210 in its "off" position. However, the presence of the protrusion 240 prevents the conductive ball 230 from rolling away from the electrical connector 226. As such, the conductive ball 230 remains in contact with the electrical connector 226 until the angle of inclination of the switch 210 reaches a critical point where gravity makes the conductive ball 230 jump over the protrusion 240. The movement of the conductive ball 230 instantly stops the flow of electricity; thus the switch 210 is instantly turned off, breaking the circuit between the housing 212 and the electrical connector 224.

The opposite occurs when the switch 210 is inclined in the opposite direction. The conductive ball 230 remains on the off side of the protrusion 240 until the switch 210 is tilted to a critical angle. As this angle of inclination is reached, the conductive ball 230 jumps over the protrusion 240, instantly activating the switch 210 by contacting both the housing 212 and the electrical connector 224.

Figure 6:
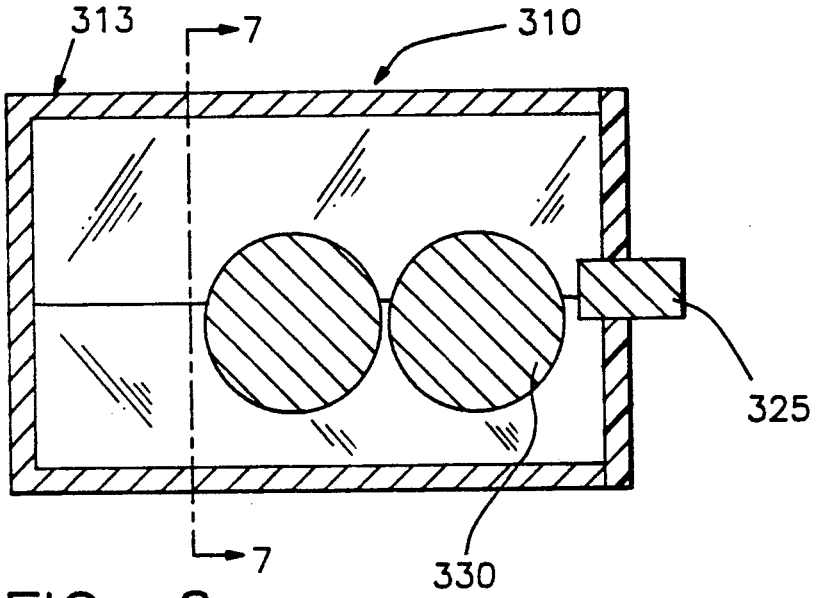
FIG. 6 is a cross-sectional view of an electric tilt switch constructed in accordance with a fourth exemplary embodiment of the present invention.
Figure 7:
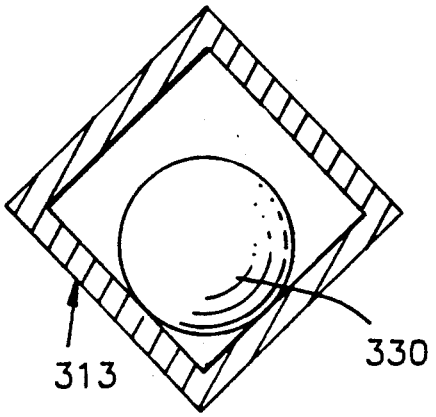
FIG. 7 is a cross-sectional view of the embodiment of the present invention shown in FIG. 6 cut along section line 7—7.

In FIGS. 6–7 a tilt switch 310 is shown having a housing 313 that is not cylindrical. In the shown embodiment, the housing 313 has a square profile, but it should be understood that the housing 313 could be formed in an geometric shape. The square shape of the shown embodiment produces advantages over the previously discussed cylindrical housing embodiments. A square housing 313 allows the conductive balls 330 in the housing 313 to contact two walls simultaneously. Obviously, since the conductive balls 330 have two point of contact with the housing 313 there is an increase in conductivity between the housing 313 and the conductive balls 330.

The embodiment of FIGS. 6–7 operates much in the same manner as the previously described embodiment of FIGS. 3 and 4. However, the embodiment of FIGS. 6–7 has the advantage of the shaped housing 313 and also includes a straight cylindrical electrical connector 325. In previously described embodiments the electrical connector was essentially T-shaped having an enlarged head to increase conductor surface area. The straight cylindrical electrical connector 325 of the present invention shows a less expensive and easier to manufacture alternative.

Figure 9:
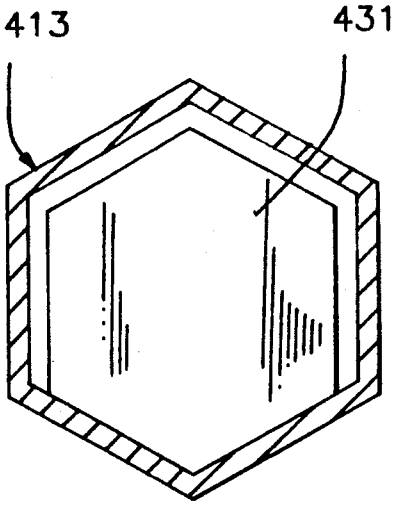
FIG. 9 is a cross-sectional view of the embodiment of the present invention shown in FIG. 8 cut along section line 9—9.
Figure 8:
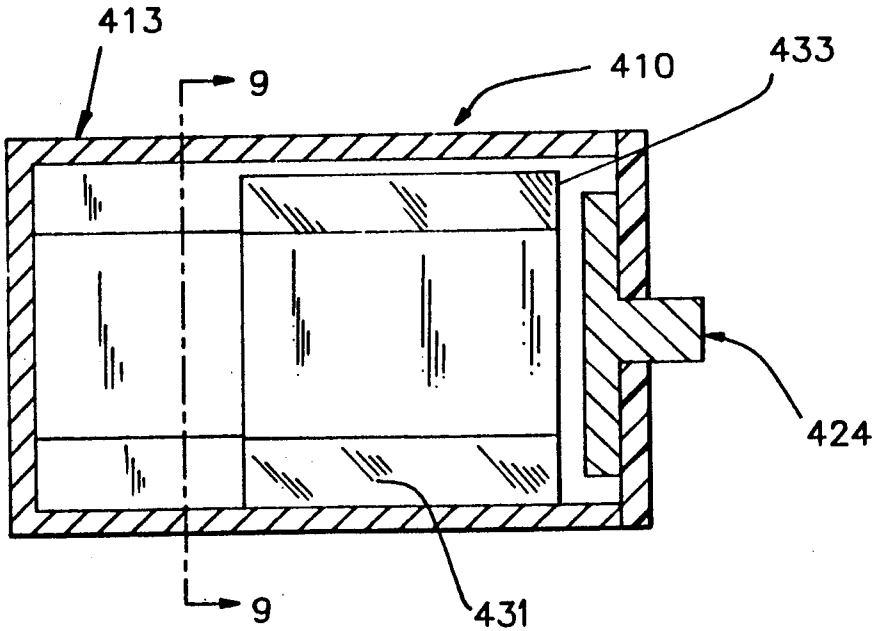
FIG. 8 is a cross-sectional view of an electric tilt switch constructed in accordance with a fifth exemplary embodiment of the present invention.

FIGS. 8–9 show a tilt switch 410 having a shaped housing 413 formed with a hexagonal profile. Within the shaped housing 413 is a sympathetically formed weight 431. The weight 431 is sized to be slightly smaller than the hollow defined by the housing 413. As such the weight 431 is free to slide back and forth within the housing 413. Since the weight 431 has the same shape as the interior of the housing 413, there is a large area of surface contact between the weight 431 and the housing 413. The shaped weight 431 has the added advantage of having a flat face surface 433. As the housing 413 is inclined the flat face 433 of the weight 431 will abut against, and contact the electrical connector 424. This embodiment results in a large area of conductive contact between the housing 413, weight 431 and electrical connector 424, making the embodiment especially adaptable to large current switching applications. The disadvantage of the shown embodiment is that the shaped weight 431 is not as sensitive to movement as would be a round ball. As such, a substantial angle of inclination must be employed before the weight 431 will move with the housing 412.

Figure 11:
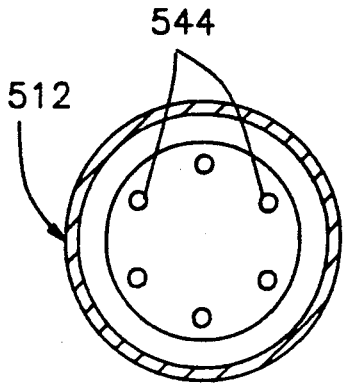
FIG. 11 is a cross-sectional view of the embodiment of the present invention shown in FIG. 10 cut along section line 11—11.
Figure 10:
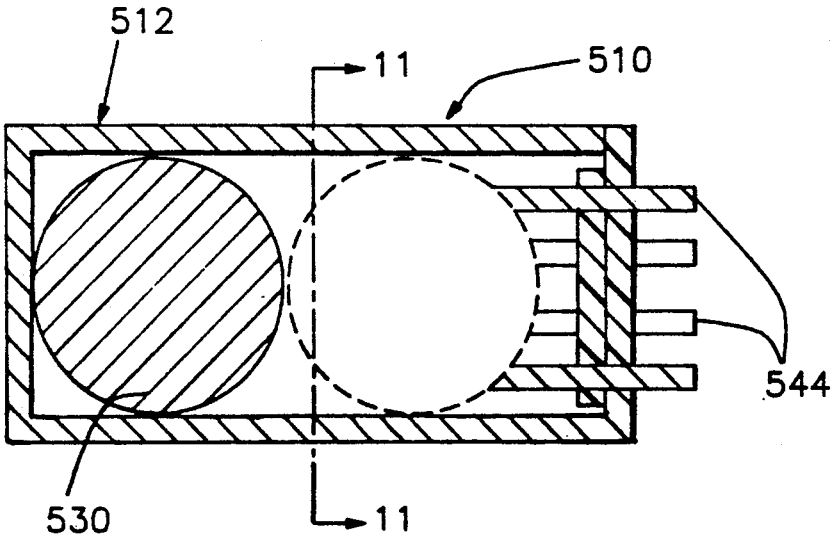
FIG. 10 is a cross-sectional view of an electric tilt switch constructed in accordance with a sixth exemplary embodiment of the present invention.

In FIGS. 10–11 a tilt switch 510 is shown having one conductive ball 530. In this embodiment the T-shaped electrical connector of previous embodiments is replaced by a plurality of connector pins 542. In previous embodiments the conductive ball(s) abutted against the face surface of the electrical connector. In such an arrangement only the tangent of each conductive ball was in actual electrical contact. The use of the plurality of connector pins 542 increases the area of surface contact proportionally with the number of connector pins 542, producing a more reliable electrical contact. In the present embodiment switch 510, the conductive ball 530 no longer conducts electricity between the housing 512 and a single electrical connector. Instead the pin connectors 543 are the means through which the switch 510 is connected to an electrical circuit. As the conductive ball 520 contacts the pin connectors 542 it electrically couples adjacent pin connectors 542 completing the desired circuit. The contact ends 544 of the pin connectors 542 abut against the conductive ball 530. The contact ends 544 may be flat, but preferably the contact ends 544 should be formed so as to maximize the surface contact area between the conductive ball 530 and the pin connectors 542.

Since an electrical circuit is completed by the conductive ball 520 contacting separate pin connectors 542 simultaneously, the housing 512 no longer acts as a source of electrical contact. As such it should appear obvious to anyone skilled in the art that the housing 512 need not be conductive and can be formed from an inexpensive dielectric material such as plastic.

Figure 13:
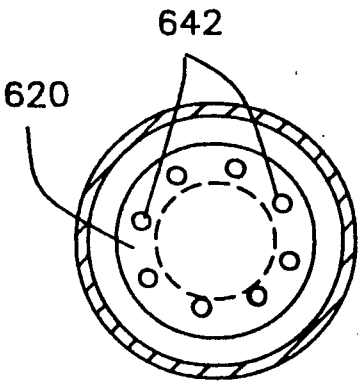
FIG. 13 is a cross-sectional view of the embodiment of the present invention shown in FIG. 12 cut along section line 13—13.
Figure 12:
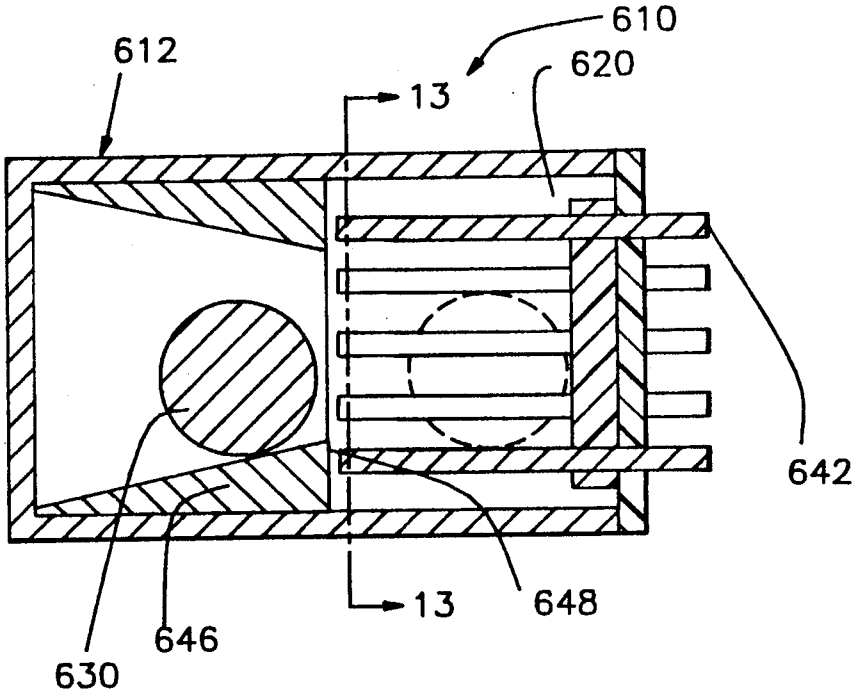
FIG. 12 is a cross-sectional view of an electric tilt switch constructed in accordance with a seventh exemplary embodiment of the present invention.

Referring to FIGS. 12–13, a tilt switch 610 is shown wherein the pin connectors 642 extend into the hollow 620 of the housing 612 a distance at least as long as the diameter of the conductive ball 630. A ramp 646 is annularly formed on the inner surface of the housing tubular jacket 614, distal the pin connectors 642. The ramp 646 increases in size as it approaches the pin connectors 642. As the switch 610 is tilted, the conductive ball 630 rolls up the ramp 646. When the switch 610 is inclined beyond a critical angle the conductive ball 630 rolls off the edge 648 of the ramp 646 and onto the pin connectors 642. The pin connectors 642 are annularly disposed and spaced so that the conductive ball 630 will always be in contact with at least two adjacent pin connectors 462. The pin connectors 642 are alternately coupled to opposing terminals from a circuit. The presence of the conductive ball 620 on at least two adjacent pin connectors 642 completes the circuit between the alternately positioned pin connectors 642. As such, when the conductive ball 630 rolls off the edge of the ramp 646 and onto the pin connectors 642, the switch 610 is instantly turned "on", completing the desired circuit.

The pin connectors 642 may be disposed to be at a level slightly lower than the highest point of the ramp 646. In this orientation the edge 648 of the ramp 646 creates a slight obstacle that prevents conductive ball 630 from rolling back onto the ramp 646, when the inclination of the switch 610 is so biased. The ramp edge 648 therefore acts as a mechanical delay. The conductive ball 630 remains in contact with the pin connectors 642 until the switch 610 is inclined at a critical angle wherein the force of gravity would pull the conductive ball 630 over the ramp edge 648 and the flow of electricity through the pin connectors would cease. The slope of the ramp 646 and the obstacle created by the relative position of the ramp edge 648 in relation to the pin connectors 642 both serve as mechanical delays and give the switch instant on and instant off characteristics that are activated inclining the switch 610 beyond a critical angle.

Figure 14:
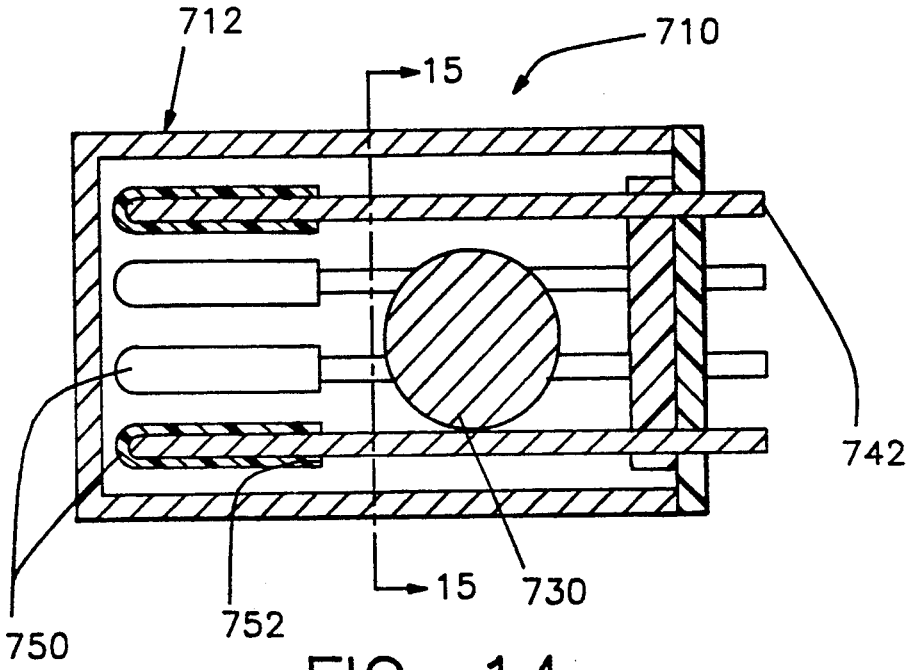
FIG. 14 is a cross-sectional view of an electric tilt switch constructed in accordance with an eighth exemplary embodiment of the present invention.
Figure 15:
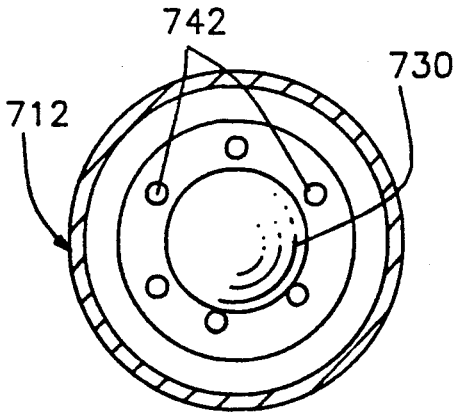
FIG. 15 is a cross-sectional view of the embodiment of the present invention shown in FIG. 14 cut along section line 11—11.

In FIGS. 14–15 a tilt switch 710 is shown wherein the pin connectors 742 extend into housing 712 to a point almost contacting the closed end 716 of the housing 712. The pin connectors 742 are parallel and are annularly disposed around the longitudinal axis of the switch 710. The conductive ball 730 is positioned within the annular ring of pin connectors 742 such that the pin connectors 742 act as rails guiding the movement of a conductive ball 730 within the housing 712. A length of each pin connector 742, proximate one end within the housing 712, is coated with an electrical insulating material. The pin connectors 742 are spaced so the conductive ball 730 will be in contact with at least two adjacent pin connectors 742 at all times. Alternate pin connectors 742 are coupled to separate biases within a circuit. The presence of the conductive ball 730 between adjacent pin connectors 742, completes the circuit. As the switch 710 is inclined, the conductive ball 730 may pass onto the section of the pin connectors that is coated with the insulating material 750. Obviously, when the conductive ball 730 is resting on the insulating material 750 the flow of electricity through the conductive ball 730 is stopped and the circuit is broken.

The pin connectors 742 need not be entirely parallel. The end of the pin connectors 742 coated with the insulating material 750 may be curved outward so as to form a descending ramp for the conductive ball 750. In such an embodiment the downward curve of the pin connectors 742 would act as a mechanical delay in the actuation of the switch 712. Similarly, the interface 752, where the insulating material 750 ends, can act as a mechanical delay, obstructing the return of the conductive ball 730 back onto the insulating material until the switch 710 is inclined past a critical angle. The result of the mechanical delays being an instant on, instant off switch as has been described in regard to previous embodiments.

Figure 16:
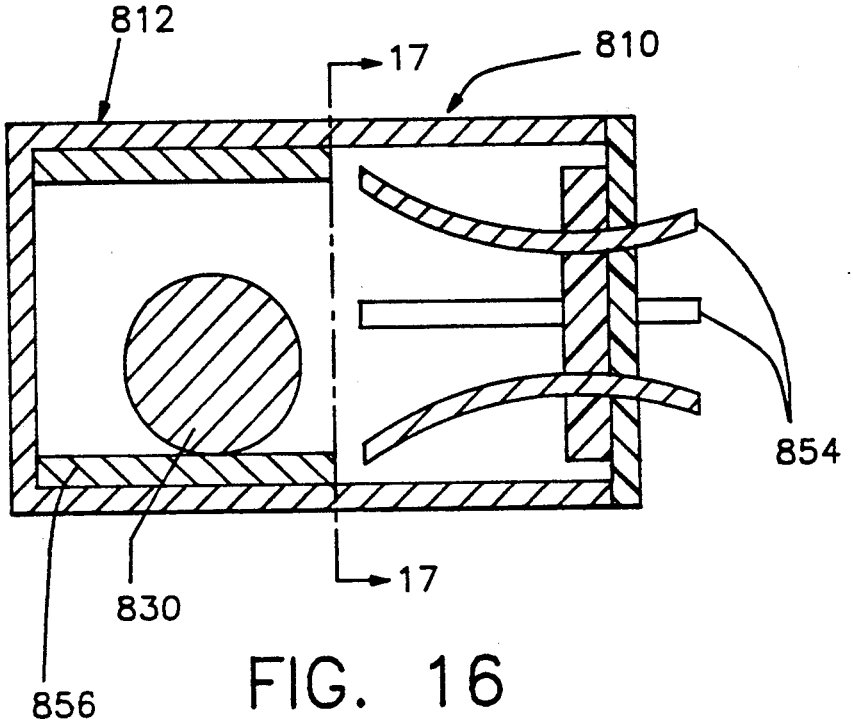
FIG. 16 is a cross-sectional view of an electric tilt switch constructed in accordance with a ninth exemplary embodiment of the present invention.
Figure 17:
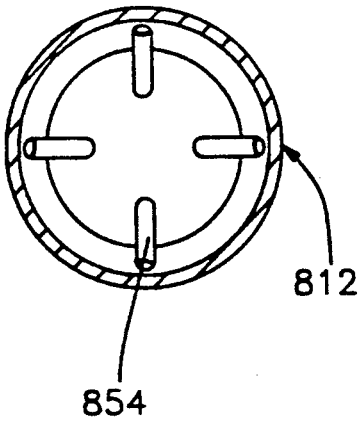
FIG. 17 is a cross-sectional view of the embodiment of the present invention shown in FIG. 16 cut along section line 13—13.

Referring to FIGS. 16–17, a tilt switch 810 is shown where the pin connectors of previous embodiments have been replaced by a plurality of flexible conductive fingers 854. The flexible fingers 854 are arranged in an annular pattern, expanding outwardly as they progress into the housing 812. A conductive ball 830 is supported within the housing 812 on an annular spacing member 856. The annular spacing member 856 supports the conductive ball 830 so that the mid-point of the conductive ball 830 is substantially in line with the longitudinal axis of the switch 812 and the longitudinal axis corresponding to the center of the annular positioning of the flexible fingers 854.

The flexible fingers 854 are alternately coupled to source and drain terminals within a circuit. The electrical coupling of any two adjacent flexible fingers 854 completing the circuit. The conductive ball 830 rests atop the annular spacing member 856 until the switch 810 is inclined in the direction of the flexible fingers 854. The conductive ball 830 rolls toward the center of the flexible fingers 854. The flexible fingers 854 diverge and are radially disposed such that the conductive ball 830 cannot contact two flexible fingers 854 simultaneously until the conductive ball 830 has traveled a substantial distance along the length of the flexible fingers 854. As the conductive ball 830 rolls off of the annular spacing member 856 and into the center of the flexible fingers 854, the first flexible fingers 854 the conductive ball 830 encounters will deform under the weight of the conductive ball 830. If the switch 810 is inclined past a predetermined critical angle, the weight of the conductive ball 830 will deform the first flexible finger 854 it contacts to a point where the conductive ball 830 will contact an adjacent flexible finger, simultaneously; thus completing the desired circuit.

The deformation of the flexible fingers 854 by the conductive ball 830 creates a spring bias in the flexible fingers 854. If the angle of inclination of the switch 810 is returned toward the horizontal, the spring bias of the flexible fingers 854 helps to push the conductive ball 830 backward, out of the center of the flexible fingers 854 and back into the center of the annular spacing member 856. The resistance set forth by the spring bias of the flexible fingers 854, in response to the advancement of the conductive ball 830, serves as a mechanical delay means for preventing the switch 810 from either connecting or disconnecting a circuit unless the switch 810 is inclined past a predetermined critical angle.

Figure 18:
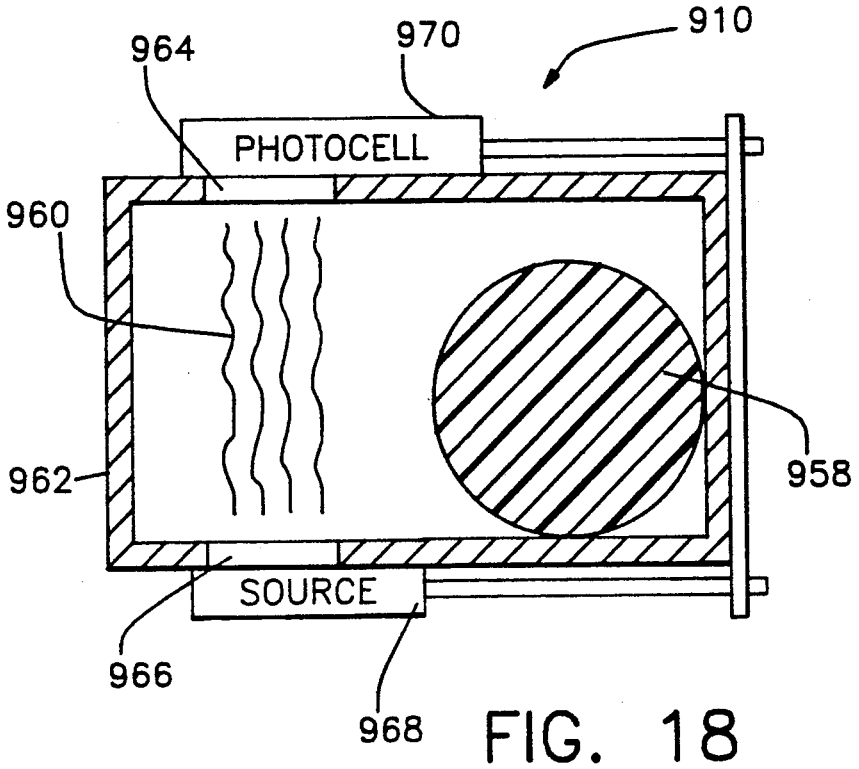
FIG. 18 is a selective cross-sectional view of an electric tilt switch constructed in accordance with a tenth exemplary embodiment of the present invention.

Referring to FIG. 18, a tilt switch 910 is shown wherein a weighted ball 958 is used to disrupt a beam of light 960. The weighted ball 958 is held within a cylindrical housing 912 having at least two opposing apertures 964, 966 through which the beam of light 960 can be transmitted. The beam of light 960 is generated by a light source 968 such as an incandescent bulb or a light emitting diode. The beam of light 960 generated by the light source 968 passes through the first aperture 966, transverses a section of the hollow 920 within the housing 912, and exits the housing 912 through the second aperture 964. The beam is detected by a photocell 970 or like device. As the switch 910 is inclined, the weighted ball 958 rolls from one side of the switch 910 to the other. When the weighted ball 958 passes through the beam of light 960 the photocell 970 is deactivated. The signal, or lack thereof, caused by the photocell 970 in response to the position of the weighted ball 958 can be used as the trigger for an electronic switching means such as a transistor or the like.

Obviously, since the weighted ball 958 does not have electricity conducted through it, the weighted ball 958 can be fabricated from a dielectric material such as plastic or ceramic. It should also be understood that the light source 968 and photocell 970 need not be limited to visible light frequencies, but may also work in the infrared. Infrared emitting sources and detection sources both being well known technologies.

Figure 19:
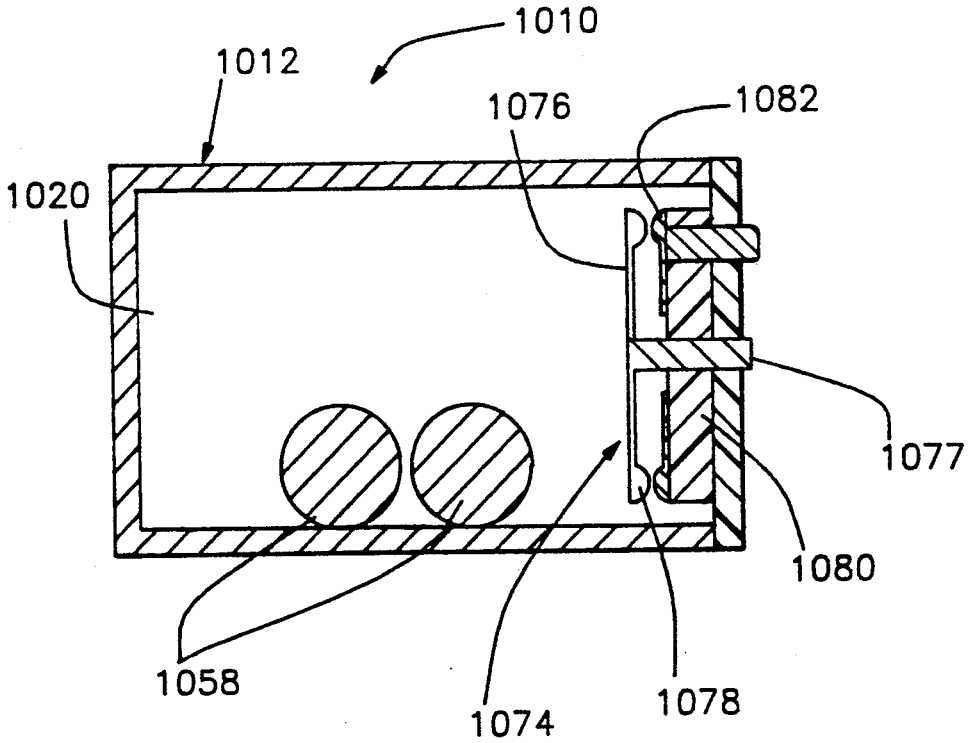
FIG. 19 is a cross-sectional view of an electric tilt switch constructed in accordance with an eleventh exemplary embodiment of the present invention.

In FIG. 19 a tilt switch 1010 is shown, wherein a circular mechanical contact switch 1074 is positioned at one end of the hollow 1020 formed within a housing 1012. The mechanical contact switch 1074 comprised of a flexible, conductive circular flange member 1076 having a conductive cylindrical stem 1077 perpendicularly depending from its center. The peripheral edge of the flange member 1076 has a protruding contact surface 1078 which may be a copper bead, a gold plated bead, or other material commonly used in electrical switch contacts.

Below the flexible flange member 1076 is a conductive base member 1080 on which an annular contact protrusion 1082 is formed. The base contact protrusion 1082 corresponds in position with the flange member contact surface 1078. When the flange member 1076 is deformed toward the base member 1080, the flange member contact surface 1078 abuts against the base contact protrusion 1082, completing a circuit.

Within the housing 1012 are positioned two weighted balls 1058. As the housing 1012 is inclined, the weighted balls 1054 either roll toward or away from the contact switch 1074. When the weighted balls 1058 contact the contact switch 1074, the weight of the balls 1058 temporarily deform the flange member 1076. Consequently the flange member contact surface 1078 abuts against the base contact protrusion 1082 and an electrical circuit is completed. When the inclination of the housing 1012 is removed or reversed, the weighted balls 1058 roll away from the flange member 1076. The flange member 1076 returns to its undeformed position and the flow of electricity between the flange member 816 and the base contact protrusion 1082 is stopped.

It should be understood that although two weighted balls 1058 are shown, a single ball or any number of balls could be used. The dimensions of the weighted balls 1058 and the pressure contact switch 1074 being so proportioned so that the bending moment applied to the flange member 1076 is maximized when the weighted ball 1058 rolls against the flange member 1076.

Figure 20:
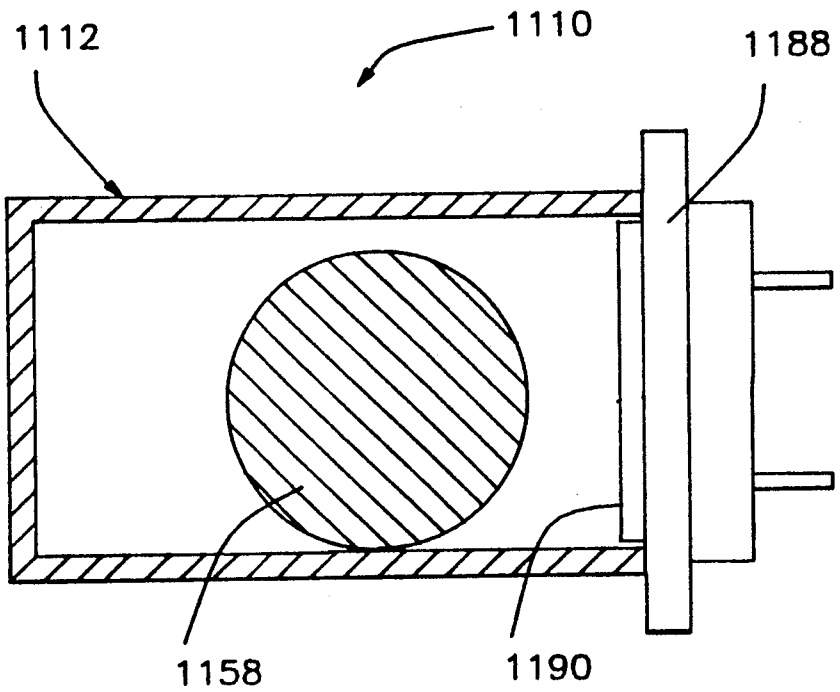
FIG. 20 is a selective cross-sectional view of an electric tilt switch constructed in accordance with a twelfth exemplary embodiment of the present invention.

In FIG. 20 a tilt switch 1110 is shown wherein one large weighted ball 1158 is used to activate a pressure sensitive piezo-electric switch 1188. The weighted ball 1158 is held within a cup-shaped housing 1112. The open end of the housing 1112 is closed with the presence of the piezo-electric switch 1188. The piezo-electric switch 1188 having its touch sensitive surface 1190 facing the weighted ball 1158 held within the housing 1112.

In operation, when the tilt switch 1110 is inclined, the weighted ball 1158 rolls toward the lowest point within the housing 1112. When the housing 1112 is inclined such that the piezo-electric switch is at the low point, the weighted ball 1148 will roll against the touch sensitive surface 1190 of the piezo-electric switch 1188 causing the piezo-electric switch to open or close a circuit. Touch sensitive piezo-electric switches are a well known technology, as is creating a piezo-electric switch that requires a minimum surface contact pressure to trigger the switch. With such technology in mind, it should be understood that the piezo-electric switch 1188 used in the present invention tilt switch 1110 may be calibrated to control the performance of the tilt switch 1110. For example, it should appear obvious that the greater the tilt angle toward the piezo-electric switch 1188, the greater the force the weighted ball 1158 applies against the piezo-electric switch 1188. As such, the force the weighted ball 1158 applies against the piezo-electric switch 1188 can be calculated for any given angle of inclination. The touch sensitive surface 1190 of the piezo-electric switch 1188 cna be so fabricated in relation to the mass of the weighted ball 1158, so that the piezo-electric switch 1188 will not be activated by the touch of the weighted ball 1158 until the angle of inclination of the tilt switch 1110 forces the weighted ball 1158 against the piezo-electric switch 1188 at an angle in excess of a predetermined critical angle.

Figure 21:
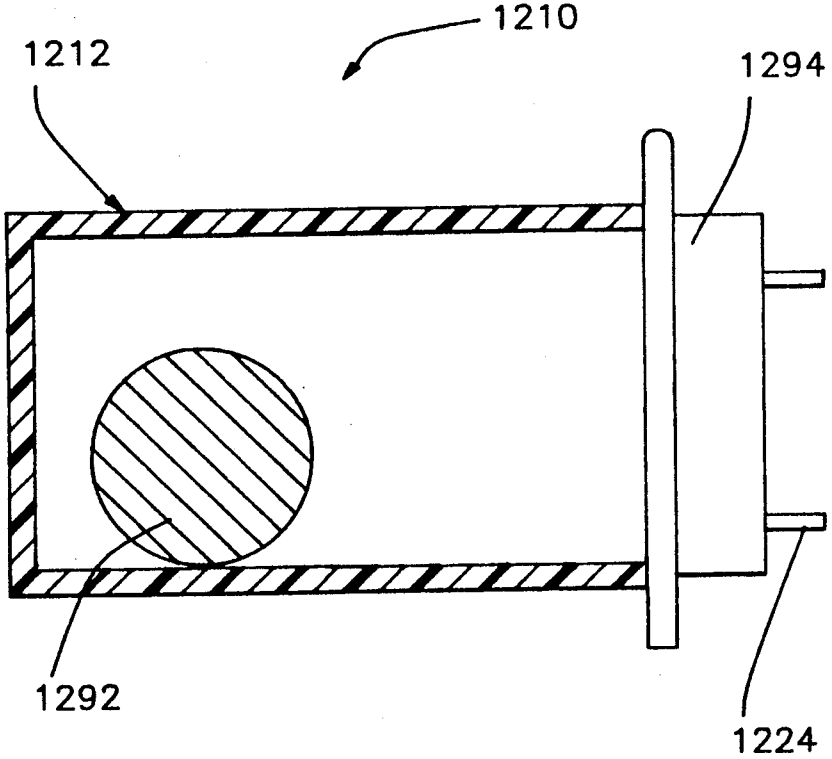
FIG. 21 is a selective cross-sectional view of an electric tilt switch constructed in accordance with a thirteenth exemplary embodiment of the present invention.

Referring to FIG. 21, a tilt switch 1210 is illustrated wherein a ball 1292, formed from a magnetized ferromagnetic material, is held within a cup-shaped housing 1212 made from a non-ferromagnetic material. The open end of the cup-shaped housing 1212 is capped with a magnetic switch 1294. When the tilt switch 1210 is inclined such that the magnetized ball 1292 rolls toward the magnetic switch 1294, the magnetic field created by the magnetic ball 1294 triggers the magnetic switch 1294. The magnetic switch 1294 then either completes or disconnects a circuit connected to the magnetic switch through leads 1224, 1234. Magnetic switches activated by the presence of a magnetic field are a well known technology. As such, a magnetic switch 1294 can be fabricated to match the magnetic field of a given magnetic ball 1294.

Figure 22:
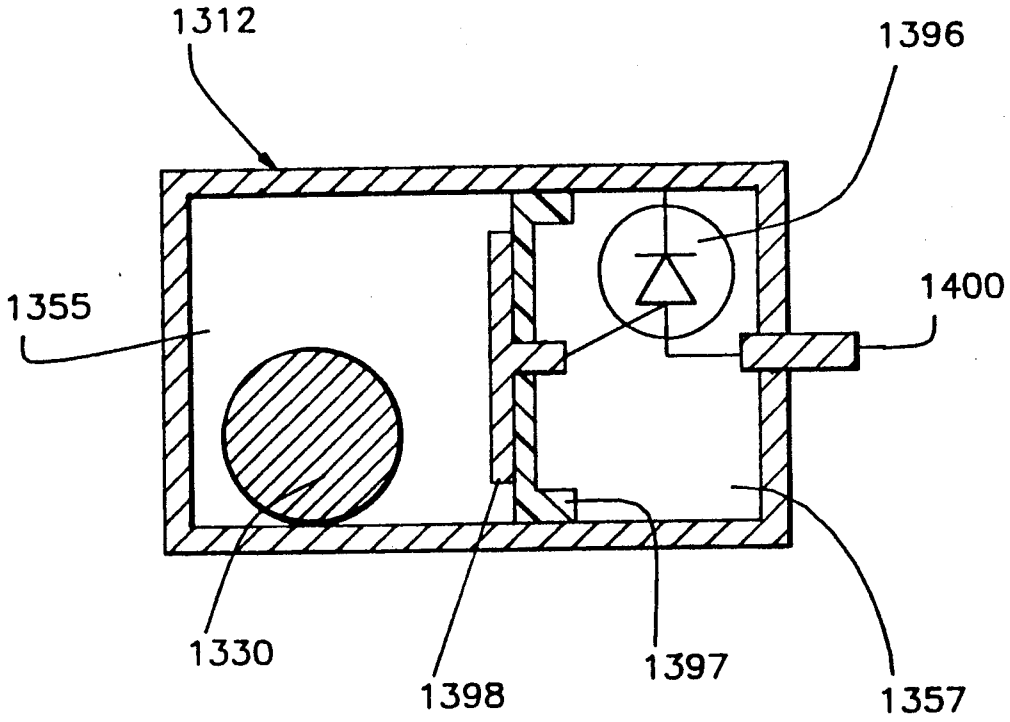
FIG. 22 is an selective cross-sectional view of an electric tilt switch constructed in accordance with a fourteenth exemplary embodiment of the present invention.

FIG. 22 shows a tilt switch 1310 wherein the housing 1312 is divided into a first and second chamber 1355, 1357 by a dividing wall 1397. In the first chamber 1355 there is positioned a conductive ball 1330 that travels freely dependant upon the inclination of the housing 1312. In the embodiment shown there exists an electrical connector 1398 protruding through the dividing wall 1397. When the housing 1312 is inclined, the conductive ball 1330 completes an electrical circuit between the housing 1312 and the electrical connector 1398. It should be understood that although one conductive ball 1330 is shown in the first chamber 1355, any of the previously described embodiments of the present invention can be incorporated within the first chamber 1355 to act as the switching means.

When the conductive ball 1330 completes a circuit between the housing 1312 and the electrical connector 1398, a electronic switching means 1396, positioned within the second chamber 1357, is triggered. The electronic switching means 1396 can be a transistor, triode or like device well-known in the art of electronic switching. The electronic switching means 1396, when activated, completes a circuit between the housing 1312 and pin connector 1400. The positioning of the electronic switching means 1396 within the housing 1312 lets the electronic switching means 1396 benefit from the inert atmosphere within the housing 1312 and otherwise physically protects the switching means.

It should be understood, however, that the electronic switching means need not be within the housing 1312, but may be alternatively positioned outside of the housing 1312 with the same switching effect.

In view of the multitude of differing embodiments described above, it should appear obvious that a person skilled in the art could combine elements for each embodiment and produce a tilt switch not specifically described herein. It should therefore be understood that the embodiments described herein are merely exemplary and that a person skilled in the art may make such variations and modifications without department from the spirit and scope of the invention. All possible combinations of the features of the disclosed embodiments and other obvious variations and modifications regarding differing physical geometric, proportions or materials are intended to be included within the scope of the invention as defined in the appended claims.

What is claimed is:

1. A tilt switch for opening and closing an electric circuit in accordance with the angle of inclination of said switch, comprising:

a cavity formed within a conductive housing, said cavity enclosing an atmosphere that is inert to conductive materials;

at least one free moving spherical weight, having a predetermined radius of curvature and a conductive circumferential surface, positioned in said cavity, said at least one spherical weight moving to an operating position within said cavity when said at least one spherical weight is biased by gravity to said operating position by the angle of inclination of said housing; and at least one conductive terminal positioned at said operating position, wherein said at least one conductive terminal has an arcuate groove of said predetermined radius of curvature disposed thereon, said at least one spherical weight engaging said arcuate groove at said operating position electrically coupling said at least one conductive terminal to said conductive housing, thereby completing said electric circuit.

2. The tilt switch of claim 1, wherein said at least one spherical weight includes a plurality of balls, each of said plurality of balls having a conductive circumferential surface, electrically coupling said conductive housing to said at least one conductive terminal when at said operating position.

3. The tilt switch of claim 1, wherein said housing means includes a substantially tubular member formed from a conductive material, said tubular member having a first and second closed end enclosing said cavity, said first closed end having a conductive connector extending therethrough that is electrically insulated from said tubular member, said conductive connector having said arcuate groove disposed thereon, whereby said at least one spherical weight contacts both said tubular member and said arcuate groove on said conductive connector, completing said electrical circuit, when said at least one spherical weight is at said operating position.

4. The tilt switch of claim 3, wherein said tubular member and said conductive connector are symmetrically disposed around a common axis and wherein said arcuate groove is annularly positioned around said common axis on said conductive connector, enabling said at least one spherical weight to engage said arcuate groove regardless to the rotation of said tubular member around said common axis.

5. The tilt switch of claim 3, wherein a plurality of spherical weights contact said tubular member and said annular groove on said conductive connector simultaneously when said plurality of spherical weights are at said operating position, each of said plurality of being electrically coupled to each other, said tubular member and said arcuate groove.

6. The tilt switch of claim 5, further including a delay means for preventing said at least one spherical weight from engaging and disengaging said arcuate groove until said tubular member is inclined in excess of a predetermined angle.

7. An electric tilt switch for opening or closing an electric circuit in accordance with the angle of inclination of said switch, comprising:

a cavity formed within a housing means, said cavity enclosing an atmosphere that is inert to conductive materials;

at least one spherical weight having a predetermined radius of curvature and being freely movable within said cavity, said at least one spherical weight moving to an operating position within said cavity when said at least one weight is biased by gravity to said operating position by the angle of inclination of said housing means; and a plurality of parallel conductive pins positioned at said operating position within said cavity, each of said conductive pins terminating along a common arcuate curve, wherein said arcuate curve has a radius of curvature generally equivalent to said predetermined radius of curvature of said at least one spherical weight, said at least one spherical weight contacting and electrically coupling each of said plurality of parallel conductive pins along said arcate curve completing closing said electric circuit, when said at least one spherical weight is at said operating position 8. The tilt switch of claim 7, further including an obstructing means for obstructing said at least one spherical weight in said cavity, said obstructing means preventing said at least one spherical weight from engaging and disengaging said plurality of conductor pins until said housing means is inclined in excess of a predetermined angle.

9. The tilt switch of claim 7, wherein said housing means and said plurality of parallel conductive pins are symmetrically disposed around a central axis, enabling said at least one spherical weight to contact said plurality of parallel conductive pins at said operating position regardless to any rotation of said housing means around said central axis.

10. The tilt switch of claim 9, wherein at least three parallel conductive pins are disposed at said operating position within said cavity, said at least one spherical weight contacting each of said at least three parallel conductive pins simultaneously when at said operating position, thereby electrically interconnecting said at least three parallel conductive pins.

11. The tilt switch of claim 10, wherein each of said at least three parallel conductive pins terminate at an end point, wherein each end point is contoured to said predetermined radius of curvature.

12. An electric tilt switch for opening or closing an electric circuit in accordance with the angle of inclination of said switch, comprising:

a housing having a cavity disposed therein, said cavity enclosing an atmosphere that is inert to conductive materials;

a plurality of parallel conductive rails positioned within said cavity and symmetrically disposed around a central axis, thereby encircling a defined area;

an insulated region within said cavity; and at least one conductive sphere freely movable within said cavity between said insulated region and said conductive rails, said conductive sphere rolling from said insulated region into said defined area, contacting at least two of said conductive rails and completing said electric circuit, as said housing is inclined beyond a predetermined angle.

13. The tilt switch of claim 12, further including an obstructing means for obstructing the passage of said at least one conductive sphere from between said insulated region and said conductive rails until said housing is inclined beyond said predetermined angle.

14. The tilt switch of claim 13, wherein said obstructing means includes a ramp structure within said insulated region, said ramp structure preventing said at least one conductive sphere from rolling onto said conductive rails until said housing is inclined in excess of said predetermined angle, thereby causing said at least one conductive sphere to traverse said ramp structure.

15. The tilt switch of claim 14, wherein said housing is generally cylindrical and disposed around said central axis, said ramp structure being annularly disposed within said housing thereby being operative in obstructing said at least one conductive sphere regardless to a rotation of said housing around said central axis.

16. The tilt switch of claim 12, wherein said plurality of parallel conductive rails extend into said cavity substantially the length of said cavity, said at least one conductive sphere being positioned within said defined area encircled by said conductive rails wherein said at least one conductive sphere rolls along at least two of said conductor rails within said cavity, said conductive rails being coated with a dielectric material within said insulated region, whereby as said at least one weight rolls upon said dielectric material there is no electrical contact between said at least one conductive sphere and said conductive rails.

17. The tilt switch of claim 16 wherein said dielectric material obstructs the movement of said at least one conductive sphere along said conductive rails, said dielectric material preventing said at least one conductive sphere from rolling between said insulated region and said conductive rails until said housing means is inclined in excess of said predetermined angle.

18. A tilt switch for opening or closing an electric circuit in accordance with the angle of inclination of said switch, comprising:

a housing having a cavity disposed therein;

at least one conductive sphere being freely movable within said cavity, said at least one conductive sphere moving to an operating position within said cavity when said at least one conductive sphere is biased by gravity to said operating position by the angle of inclination of said housing;

a plurality of flexible conductive connectors extending within said cavity proximate said operating position, said flexible conductive connectors being symmetrically disposed around a central axis, thereby encircling a defined area, wherein as said at least one conductive sphere rolls within said defined area, said at least one conductive sphere contacts and deforms one of said flexible conductive connectors which resists the advancement of said at least one conductive sphere into said defined area, said at least one conductive sphere advancing within said defined area and contacting at least two of said flexible conductive connectors completing said electric circuit as said housing is inclined in excess of a predetermined angle.

19. The tilt switch according to claim 18, wherein said plurality of flexible conductive connectors diverge from said operating position, whereby said defined area narrows proximate said operating position.

* * * * *